US012302989B2

(12) United States Patent
Wang

(10) Patent No.: US 12,302,989 B2
(45) Date of Patent: May 20, 2025

(54) MOISTURE-PERMEABLE WATERPROOF SHOE

(71) Applicant: VESSI FOOTWEAR LTD., Vancouver (CA)

(72) Inventor: Hung-Jung Wang, Taichung (TW)

(73) Assignee: VESSI FOOTWEAR LTD., Vancouver (CA)

( * ) Notice: Subject to any disclaimer, the term of this patent is extended or adjusted under 35 U.S.C. 154(b) by 253 days.

(21) Appl. No.: 17/589,515

(22) Filed: Jan. 31, 2022

(65) Prior Publication Data

US 2023/0008469 A1 Jan. 12, 2023

(30) Foreign Application Priority Data

Jul. 12, 2021 (TW) ..... 110208135

(51) Int. Cl.
*A43B 23/07* (2006.01)

(52) U.S. Cl.
CPC ..... *A43B 23/07* (2013.01)

(58) Field of Classification Search
CPC ..... A43B 23/07; A43B 23/022; A43B 7/125; A43B 17/10
USPC ..... 2/135; 36/3 B, 25 R, 10
See application file for complete search history.

(56) References Cited

U.S. PATENT DOCUMENTS

2003/0009908 A1* 1/2003 Sheets ..... A43B 7/125 36/55
2004/0006888 A1* 1/2004 Moretti ..... A43B 9/00 36/3 B
2007/0186444 A1* 8/2007 Hsiao ..... A43B 19/00 36/55
2010/0011619 A1* 1/2010 Bastianelli ..... A43B 9/02 36/87
2014/0082961 A1* 3/2014 Marvin ..... A43B 23/0215 36/47
2019/0223545 A1* 7/2019 Chang ..... A43B 1/14

* cited by examiner

*Primary Examiner* — Nathan E Durham
*Assistant Examiner* — Abby M Spatz
(74) *Attorney, Agent, or Firm* — HSML P.C.

(57) ABSTRACT

A moisture-permeable waterproof shoe includes an upper defining an interior space, and an inner sleeve unit disposed in the interior space and including a shoe-shaped inner sleeve defining a foot space and having an inner sleeve bottom surface, a moisture-permeable waterproof layer located on an outer side thereof, and a bottom seam formed on the inner sleeve bottom surface. A waterproof unit includes a bottom waterproof strip fixed to an outer surface of the waterproof layer at a position corresponding to the bottom seam so as to cover the bottom seam and formed with at least one gap. A bottom sealing member is fixed to the inner sleeve bottom surface. A sole is fixed to a bottom portion of the upper.

6 Claims, 17 Drawing Sheets

MOISTURE-PERMEABLE WATERPROOF SHOE

CROSS-REFERENCE TO RELATED APPLICATION

This application claims priority to Taiwanese Patent Application No. 110208135, filed on Jul. 12, 2021.

FIELD

The disclosure relates to a shoe, more particularly to a moisture-permeable waterproof shoe.

BACKGROUND

Referring to FIGS. 1 to 3, a conventional moisture-permeable waterproof shoe includes an upper 1, an inner sleeve unit 2 fixed inside the upper 1, and a sole 3 fixed to a bottom portion of the upper 1. The inner sleeve unit 2 includes a shoe-shaped inner sleeve 201, a plurality of waterproof strips 202, and a waterproof jacket 203. The inner sleeve 201 has a moisture-permeable waterproof layer 204 located on an outer side thereof. The waterproof strips 221 are fixed to an outer surface of the moisture-permeable waterproof layer 204 so as to cover the seams of the inner sleeve 201. A bottom portion of the inner sleeve 201 is disposed on the waterproof jacket 203. The waterproof jacket 203 can cover the waterproof strip 202 that is located on the bottom portion of the inner sleeve 201.

Although the aforesaid conventional moisture-permeable waterproof shoe can make use of the waterproof jacket 203 to cover the waterproof strip 202 located on the bottom portion of the inner sleeve 201 to further increase the waterproof effect thereof, during assembly of the waterproof jacket 203 and the inner sleeve 201, since the outer side of the inner sleeve 201 is covered with the moisture-permeable waterproof layer 204 and the seams thereof are completely covered by the waterproof strips 202 at the same time, residual air is often trapped between the waterproof jacket 203 and a bottom surface of the inner sleeve 201 to form air bubbles (known in the industry as entrained air). In this way, because the waterproof jacket 203 and the inner sleeve 201 cannot abut against each other at portions where the air bubbles are located, after wearing the shoe for a long time, the waterproof jacket 203 and the inner sleeve 201 are often damaged due to rubbing against each other at portions where the air bubbles are located.

SUMMARY

Therefore, an object of the present disclosure is to provide a moisture-permeable waterproof shoe that is capable of alleviating at least one of the drawbacks of the prior art.

Accordingly, a moisture-permeable waterproof shoe of this disclosure includes an upper, an inner sleeve unit, and a sole. The upper defines an interior space, and has a top open end communicating with the interior space. The inner sleeve unit is disposed in the interior space, and includes a shoe-shaped inner sleeve, a waterproof unit and a bottom sealing member. The shoe-shaped inner sleeve defines a foot space, and includes an inner sleeve bottom surface, a moisture-permeable waterproof layer located on an outer side thereof, and a bottom seam formed on the inner sleeve bottom surface and extending along a front-rear direction. The inner sleeve has a top open end communicating with the foot space for entry of a foot of a user thereinto and corresponding to the top open end of the upper.

The waterproof unit includes a bottom waterproof strip fixed to an outer surface of the moisture-permeable waterproof layer at a position corresponding to the bottom seam so as to cover the bottom seam and formed with at least one gap. The bottom sealing member is fixed to the inner sleeve bottom surface. The sole is fixed to a bottom portion of the upper.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
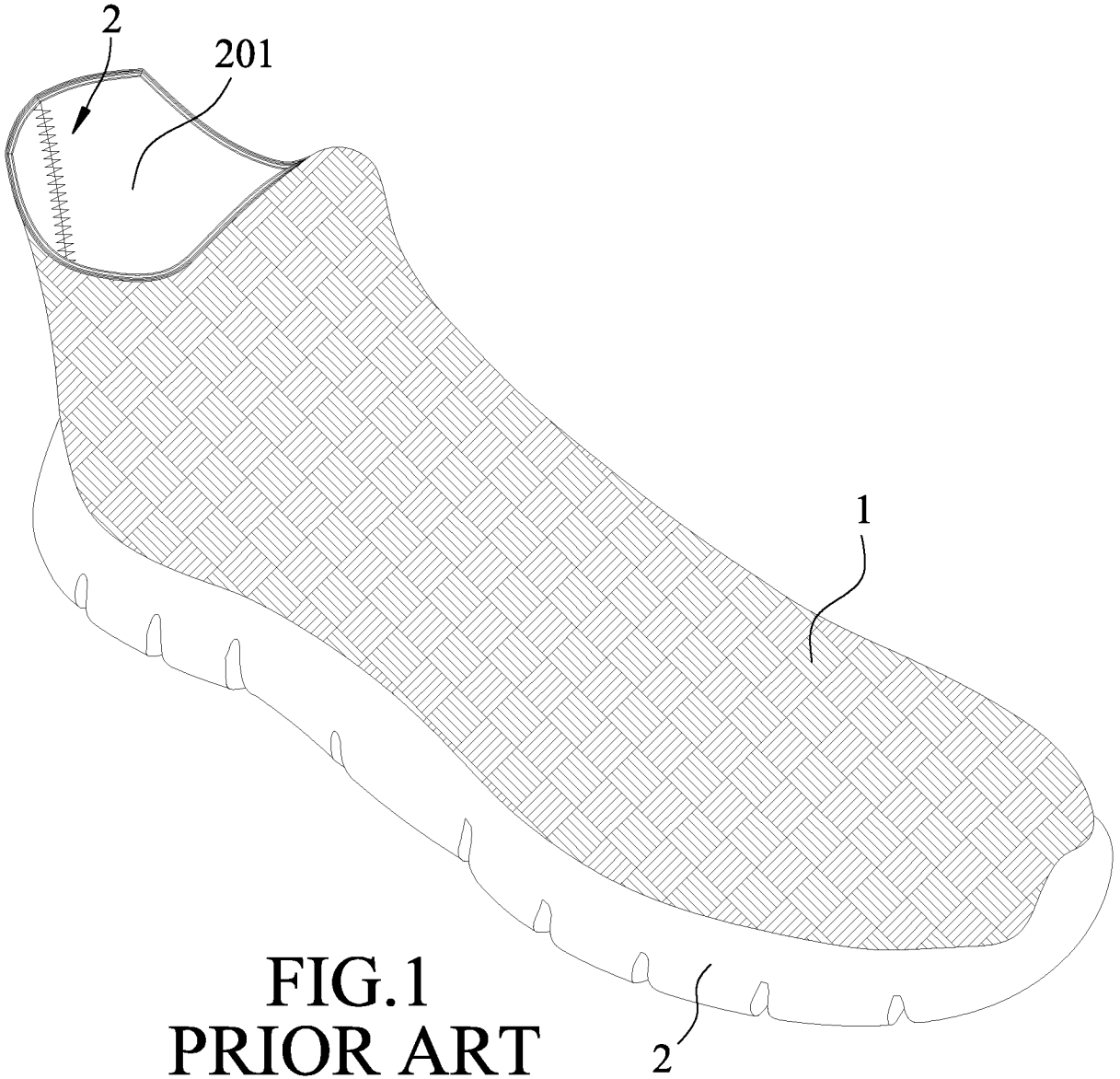
FIG.1 PRIOR ART
FIG. 1 is a perspective view of a conventional moisture-permeable waterproof shoe.
Figure 2:
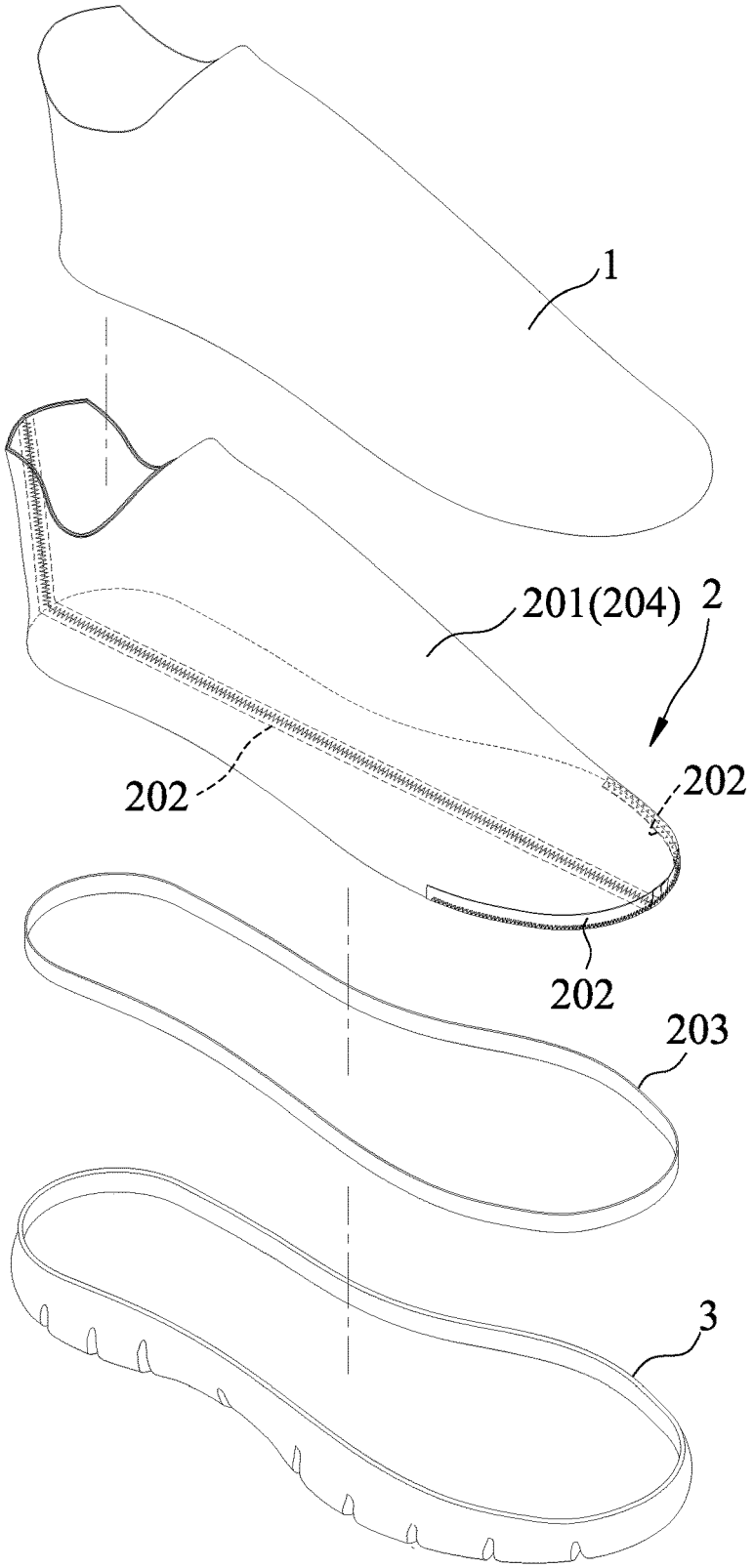
FIG.2 PRIOR ART
FIG. 2 is an exploded perspective view of the conventional moisture-permeable waterproof shoe.
Figure 3:
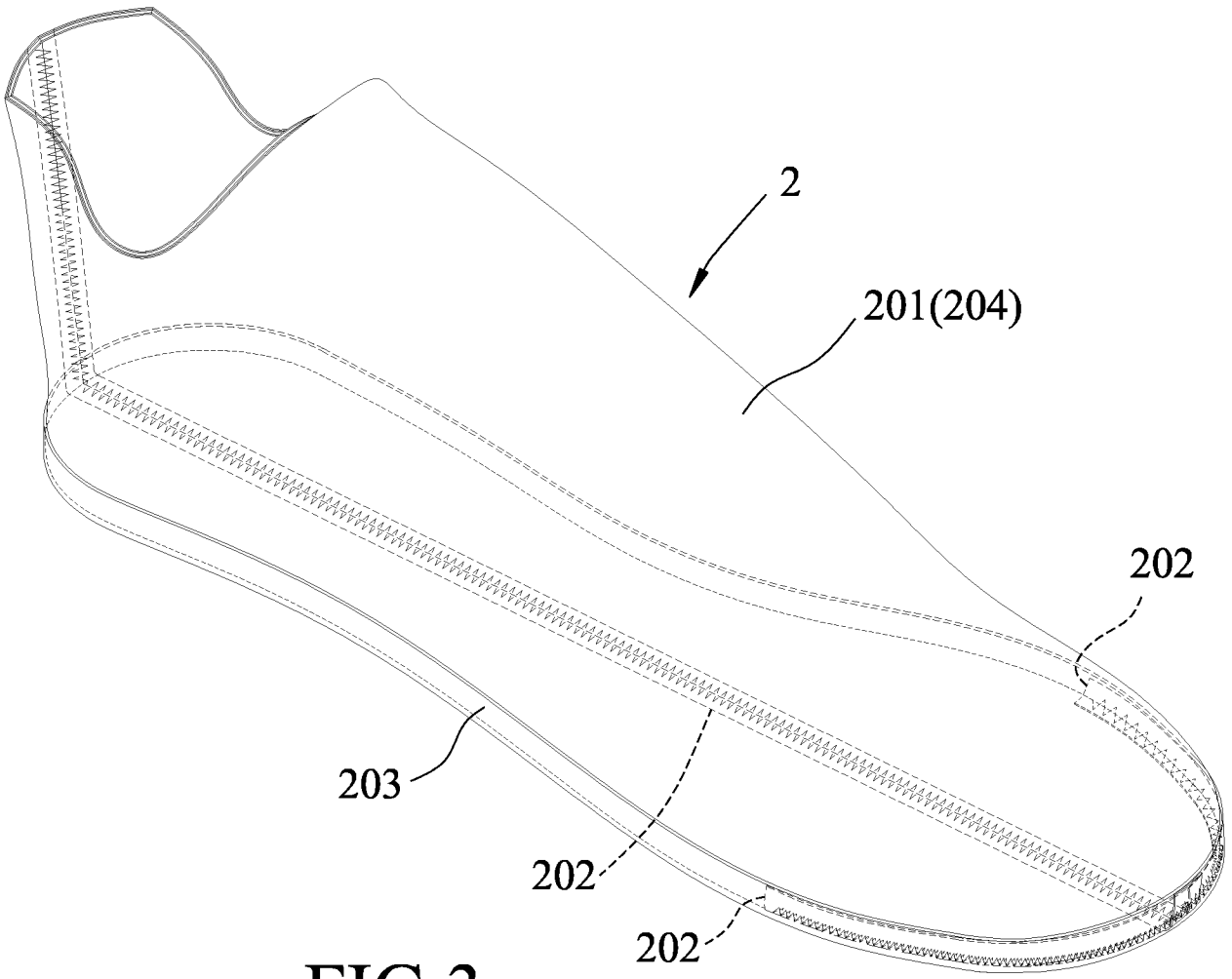
FIG.3 PRIOR ART
FIG. 3 is an assembled perspective view of an inner sleeve unit of the conventional moisture-permeable waterproof shoe.
Figure 4:
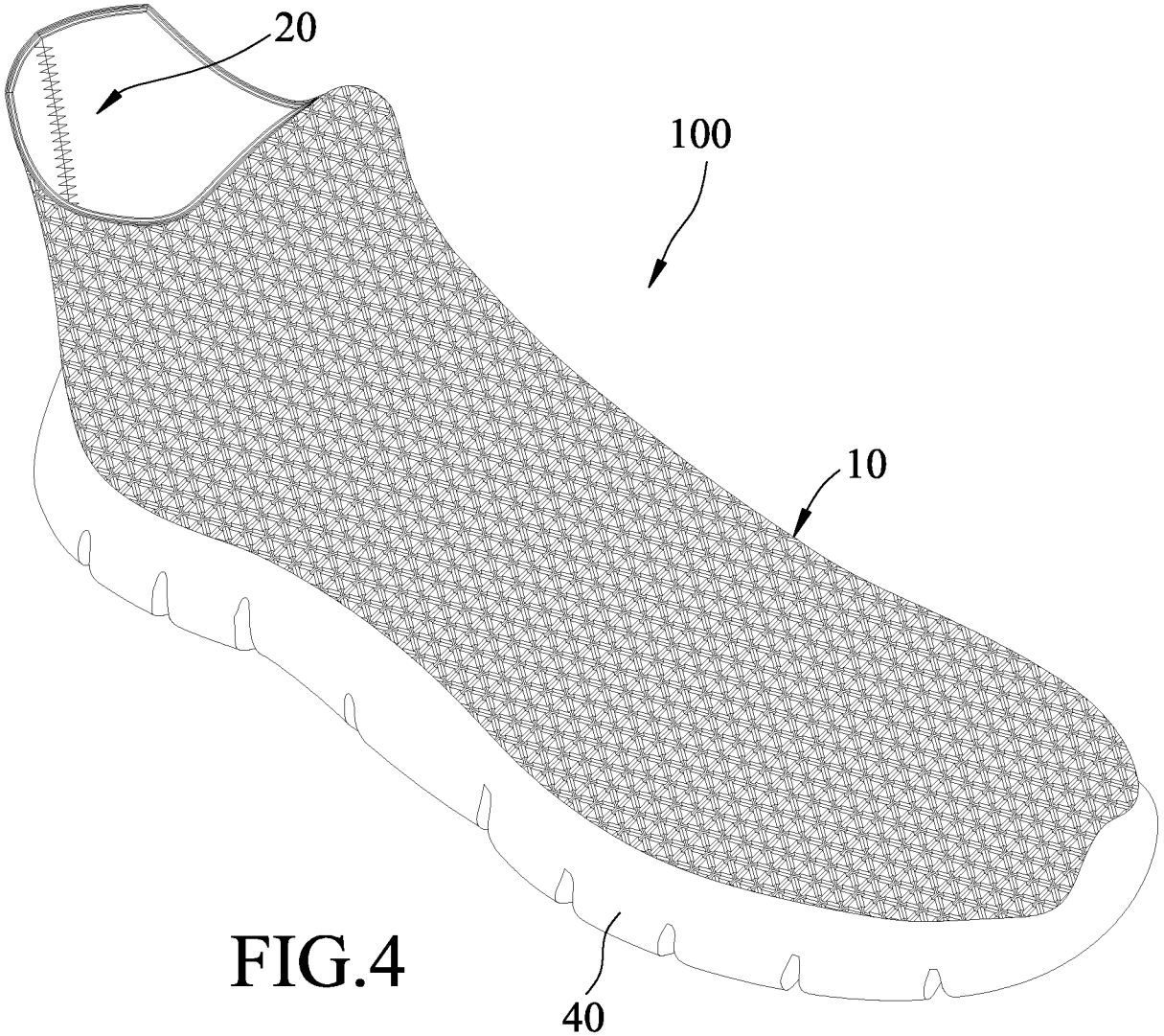
FIG. 4 is a perspective view of a moisture-permeable waterproof shoe according to the first embodiment of the present disclosure.

Before the present disclosure is described in greater detail with reference to the accompanying embodiments, it should be noted herein that like elements are denoted by the same reference numerals throughout the disclosure.

Referring to FIGS. 4 to 7, a moisture-permeable waterproof shoe 100 according to the first embodiment of the present disclosure is shown to include an upper 10, an inner sleeve unit 20, a connecting layer 30, a sole 40, and an adhesive layer 50.

The upper 10 defines an interior space 11, and has a top open end 12 communicating with the interior space 11. In this embodiment, a bottom portion of the upper 10 may also be open, but is not limited thereto.

The inner sleeve unit 20 is disposed in the interior space 11, and includes a shoe-shaped inner sleeve 60, a waterproof unit 70, a bottom sealing member 80, and a bonding layer 90.

The shoe-shaped inner sleeve 60 defines a foot space 69, and has a top open end 601 communicating with the foot space 69 for entry of a user's foot thereinto and corresponding to the top open end 12 of the upper 10. The inner sleeve 60 includes an inner sleeve bottom surface 61, an inner sleeve peripheral surface 62, a front end seam 63, a rear end seam 64, and a bottom seam 65 extending along a front-rear direction (X). In this embodiment, the bottom seam 65 is mainly formed on the inner sleeve bottom surface 61, and has a front end extending to a front end of the inner sleeve peripheral surface 62.

Figure 9:
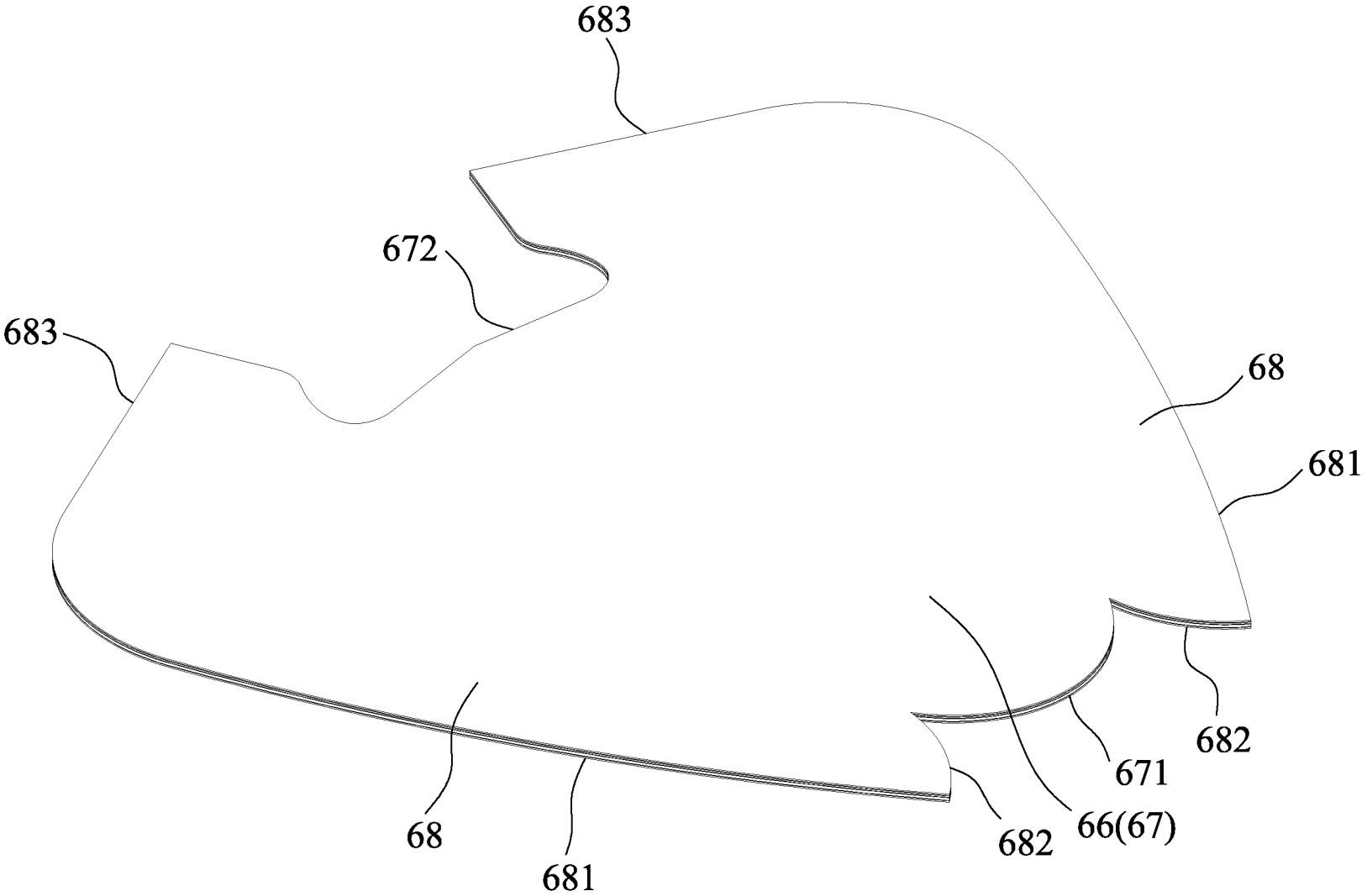
FIG. 9 is a perspective view of a cut piece for forming a shoe-shaped inner sleeve of an inner sleeve unit of the first embodiment.

In this embodiment, the inner sleeve 60 is made from a cut piece 66 (see FIG. 9). The cut piece 66 includes a lining layer 661, an outer fabric layer 662, a foam layer 663 fixed between the lining layer 661 and the outer fabric layer 662, and a moisture-permeable waterproof layer 664 fixed to an outer surface of the outer fabric layer 662.

Figure 10:
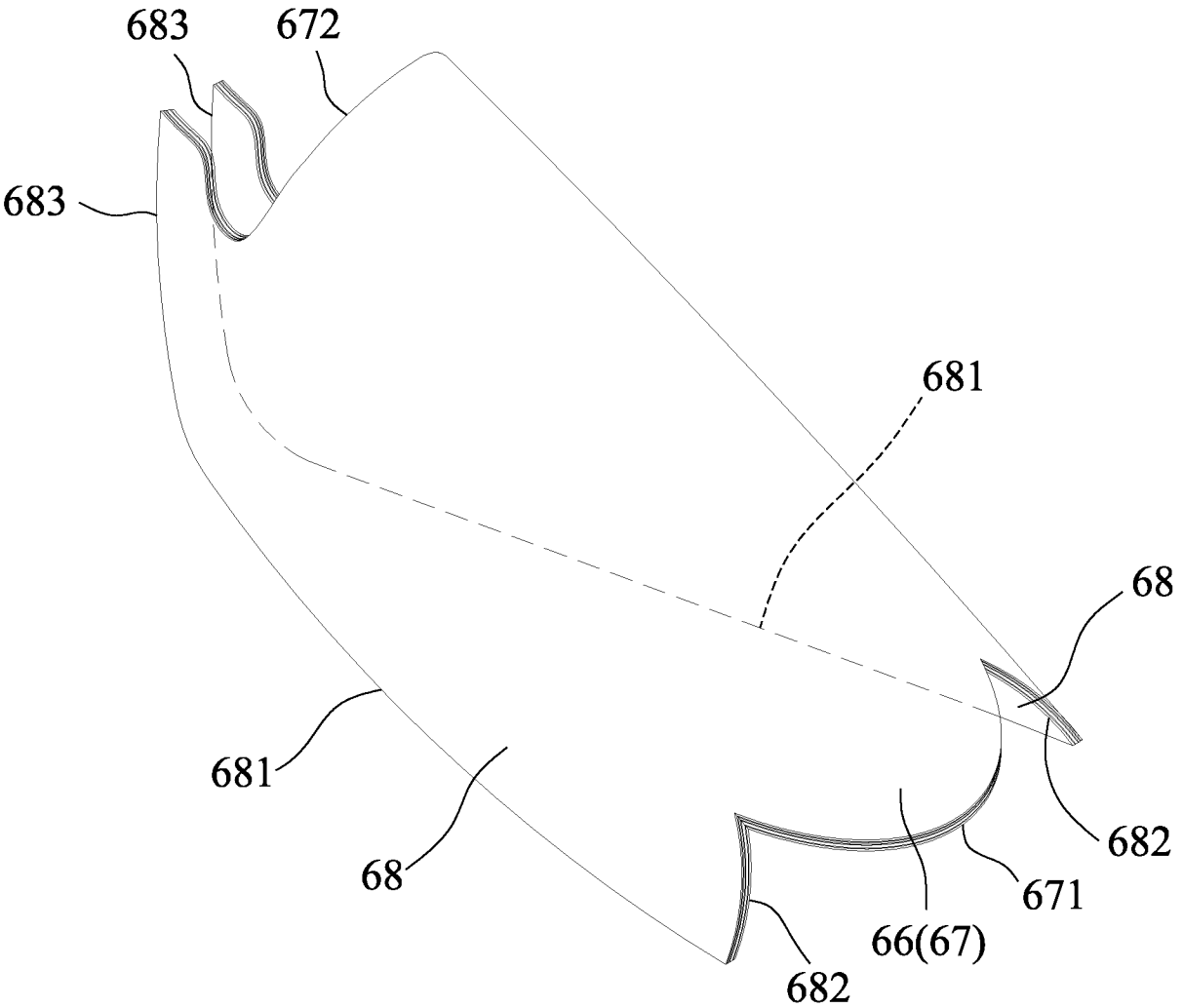
FIG. 10 illustrates the cut piece being folded.
Figure 11:
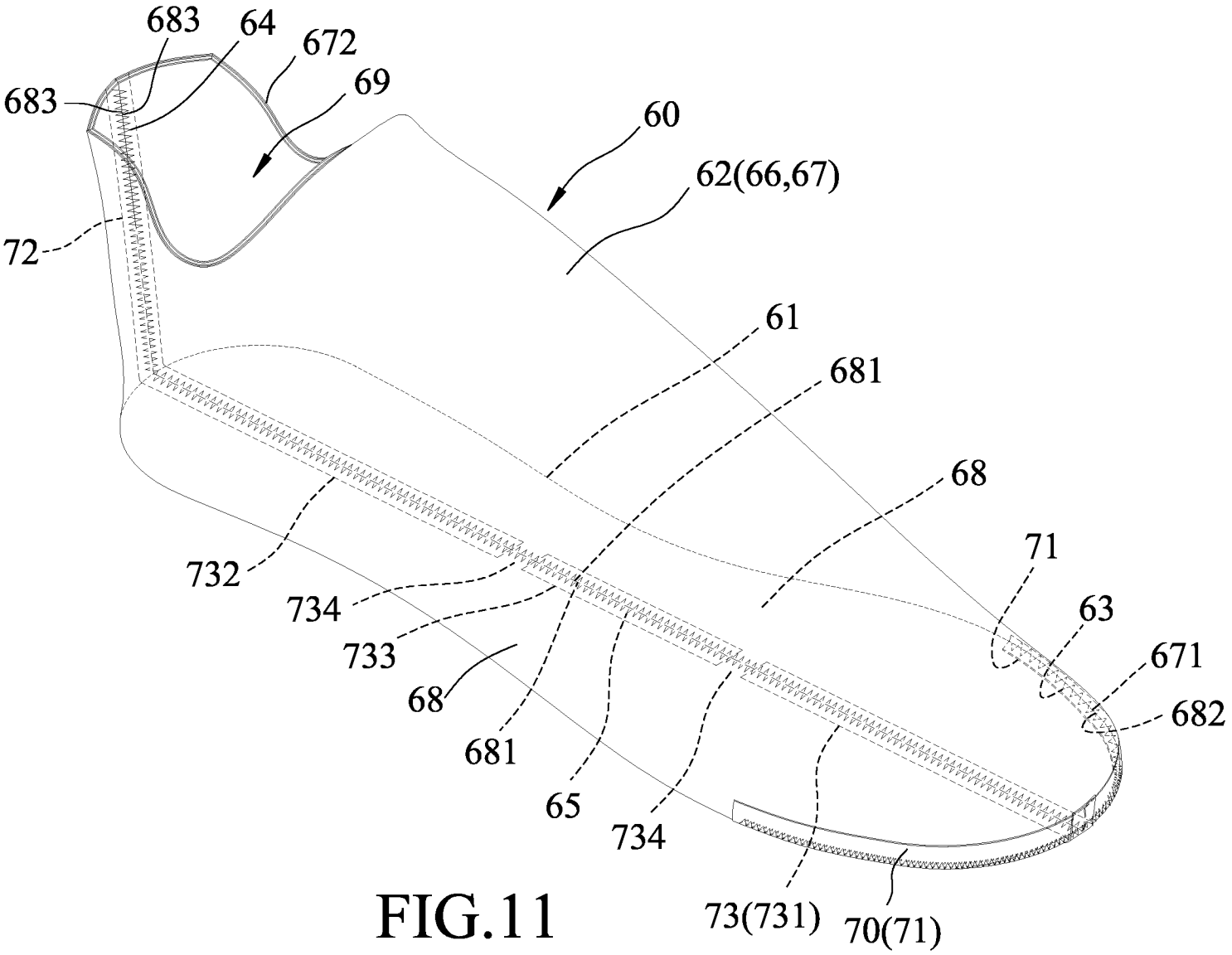
FIG. 11 illustrates how different parts of the cut piece are interconnected by sewing to form the shoe-shaped inner sleeve and how a waterproof unit covers the seams of the shoe-shaped inner sleeve.

Referring to FIGS. 9 to 11, the cut piece 66 has a main body 67, and two wing portions 68 symmetrically disposed on two opposite sides of the main body 67 and integrally connected as one piece with the main body 67. The main body 67 has a front convex edge 671 and a rear concave edge 672 opposite to each other. Each wing portion 68 has a wing lateral edge 681 spaced apart from the main body 67 and having a front end and a rear end, a front curved mating edge 682 connected between the front end of the wing lateral edge 681 and a corresponding one of two opposite ends of the front convex edge 671, and a rear mating edge 683 connected between the rear end of the wing lateral edge 681 and a corresponding one of two opposite ends of the rear concave edge 672. The front curved mating edges 682 of the wing portions 68 are sewn to a periphery of the front convex edge 671 to form the front end seam 63, the wing lateral edges 681 of the wing portions 68 are sewn to each other to form the bottom seam 65, and the rear mating edges 683 of the wing portions 68 are sewn to each other to form the rear end seam 64, thereby forming the shoe-shaped inner sleeve 60.

In this embodiment, the front end seam 63 extends along a junction of the periphery of the front convex edge 671 and the front curved mating edges 682 of the wing portions 68, the bottom seam 65 extends along a junction of the wing lateral edges 681 of the wing portions 68, and the rear end seam 64 extends along a junction of the rear mating edges 683 of the wing portions 68 and extends upwardly from and is connected to a rear end of the bottom seam 65.

Figure 7:
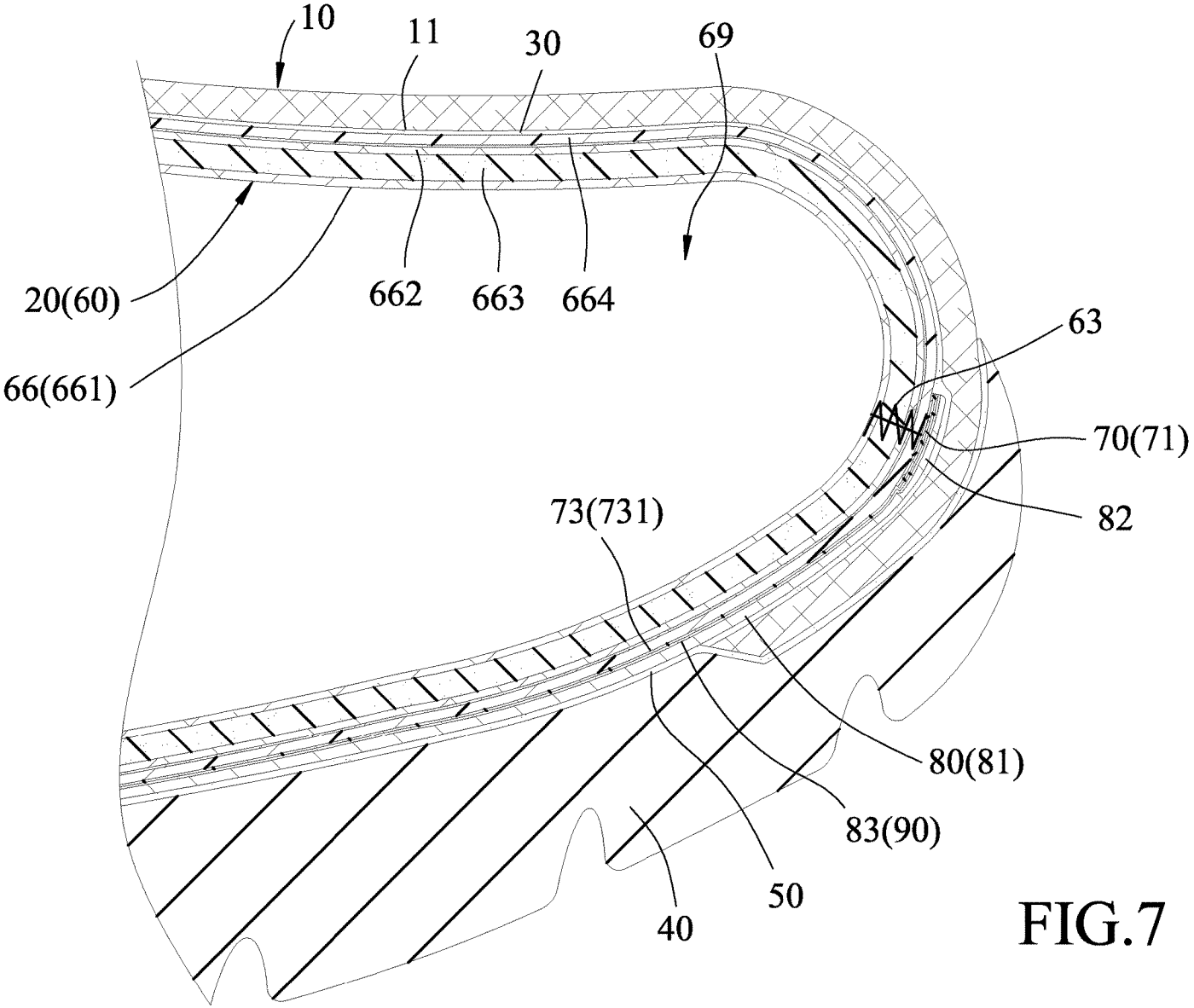
FIG. 7 is an enlarged fragmentary sectional view of FIG. 6.
Figure 8:
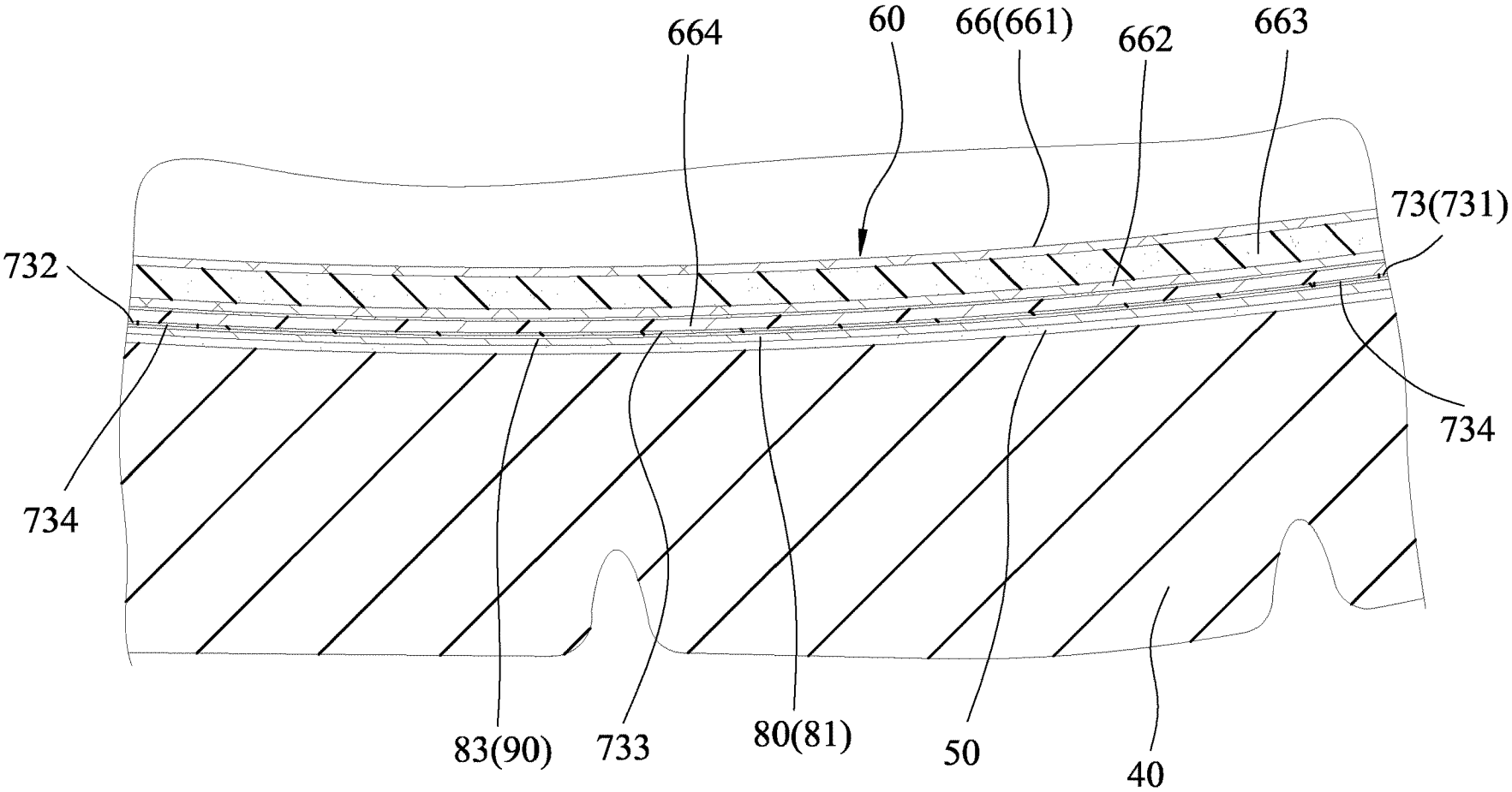
FIG. 8 is another enlarged fragmentary sectional view of FIG. 6.

With reference to FIGS. 7, 8, and 11, the waterproof unit 70 includes two front end waterproof strips 71, a rear end waterproof strip 72, and a bottom waterproof strip 73. The front end waterproof strips 71 are fixed to an outer surface of the moisture-permeable waterproof layer 664 of the inner sleeve 60 at a position corresponding to the junction of the periphery of the front convex edge 671 and the front curved mating edges 682 of the wing portions 68 so as to cover the front end seam 63. The rear end waterproof strip 72 is fixed to the outer surface of the moisture-permeable waterproof layer 664 of the inner sleeve 60 at a position corresponding to the junction of the rear mating edges 683 of the wing portions 68 so as to cover the rear end seam 64.

The bottom waterproof strip 73 is fixed to the outer surface of the moisture-permeable waterproof layer 664 of the inner sleeve 60 at a position corresponding to the bottom seam 65 so as to cover the same. In this embodiment, the bottom waterproof strip 73 has a front strip section 731, a rear strip section 732, and an intermediate strip section 733 between the front and rear strip sections 731, 732. The bottom waterproof strip 73 is formed with two gaps 734 respectively located between the front strip section 731 and one end of the intermediate strip section 733 and between the rear strip section 732 and the other end of the intermediate strip section 733. Each gap 734 has a length of 1 to 3 cm along the front-rear direction (X). It can be appreciated that, in other variations of this embodiment, the number of the gap 734 may be one or more than two.

In this embodiment, the front strip section 731 of the bottom waterproof strip 73 interlace with the front end waterproof strips 71, while the rear end waterproof strip 72 is integrally connected as one piece with the rear strip section 732 of the bottom waterproof strip 73.

Figure 5:
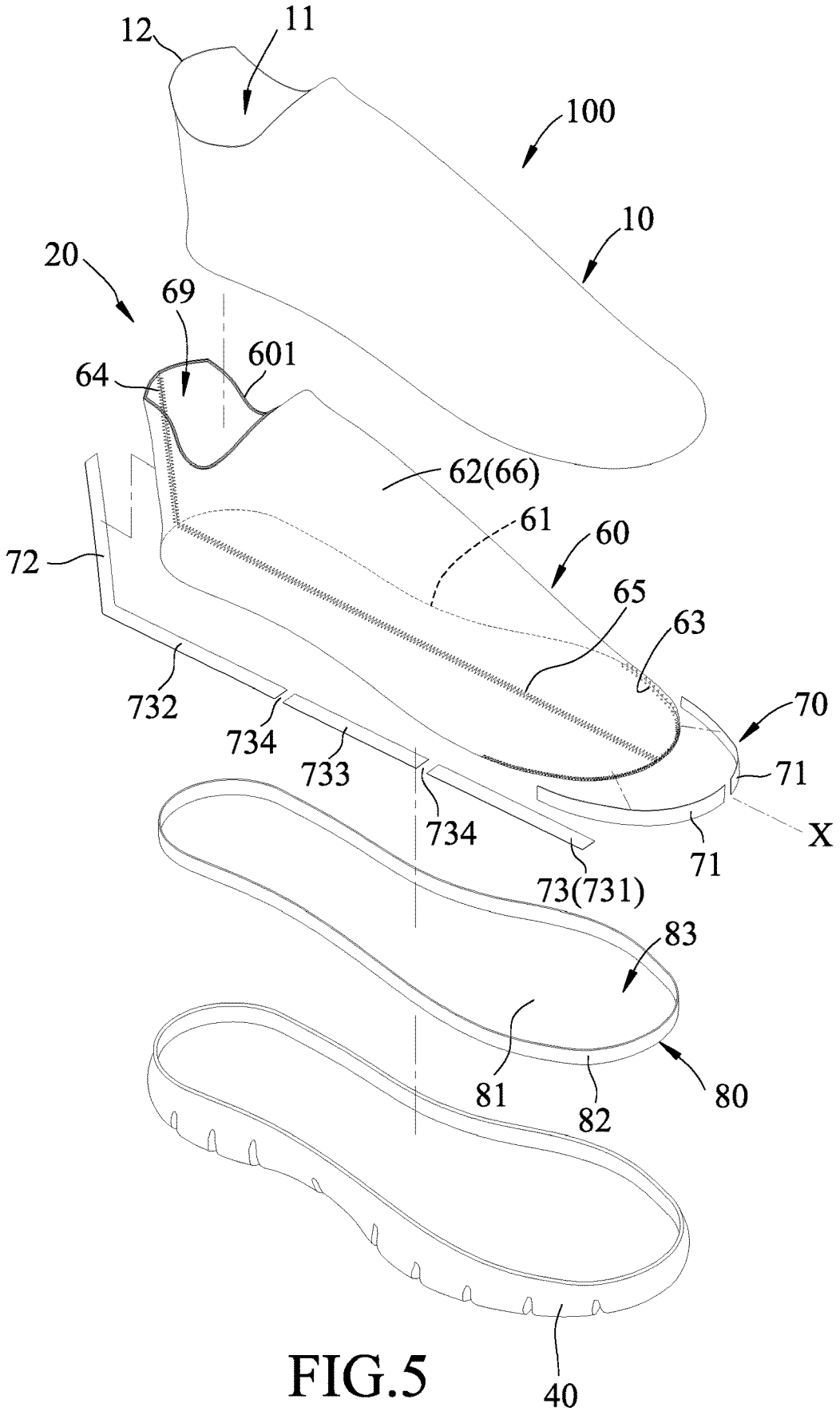
FIG. 5 is an exploded perspective view of the first embodiment.
Figure 6:
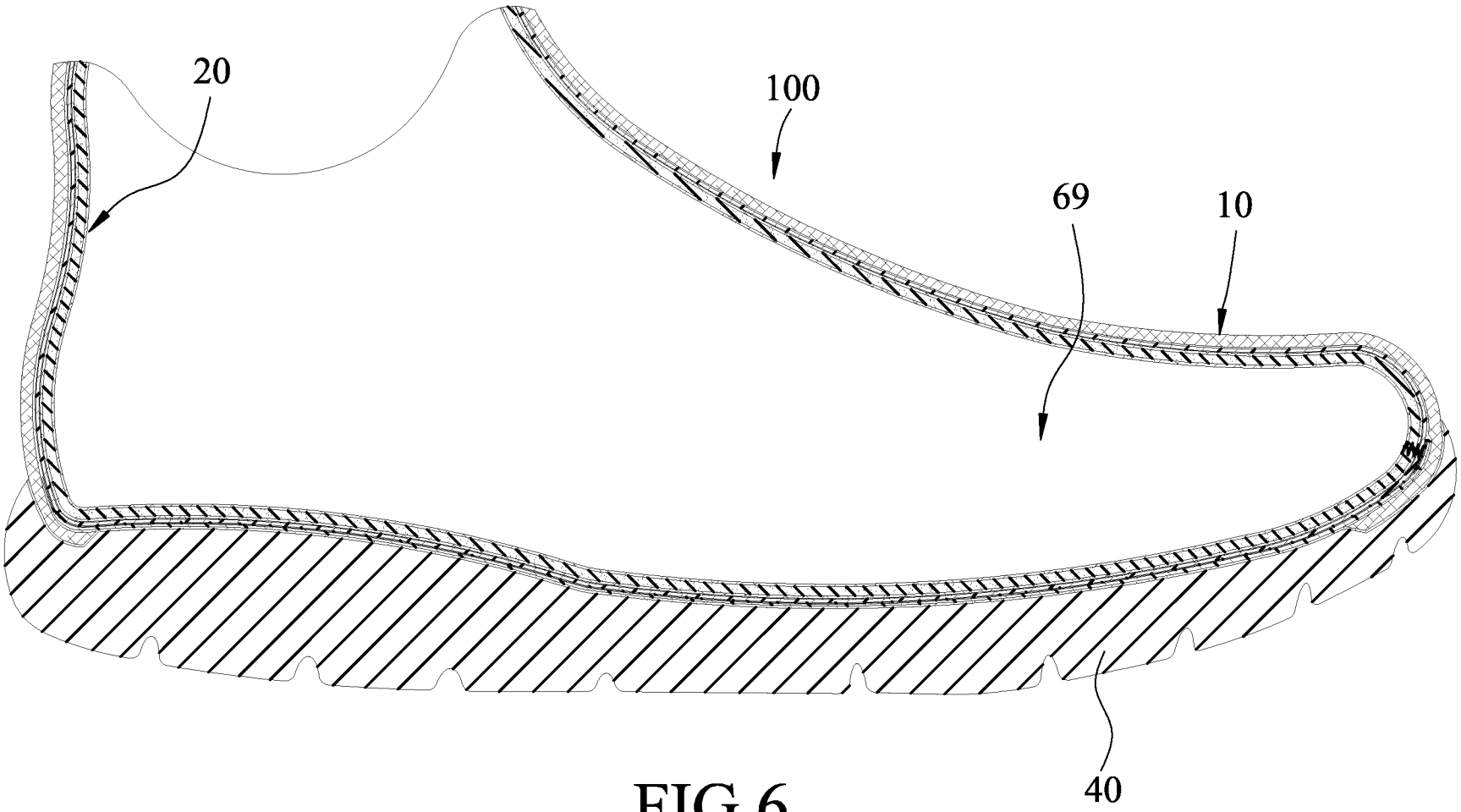
FIG. 6 is an assembled sectional side view of the first embodiment.
Figure 12:
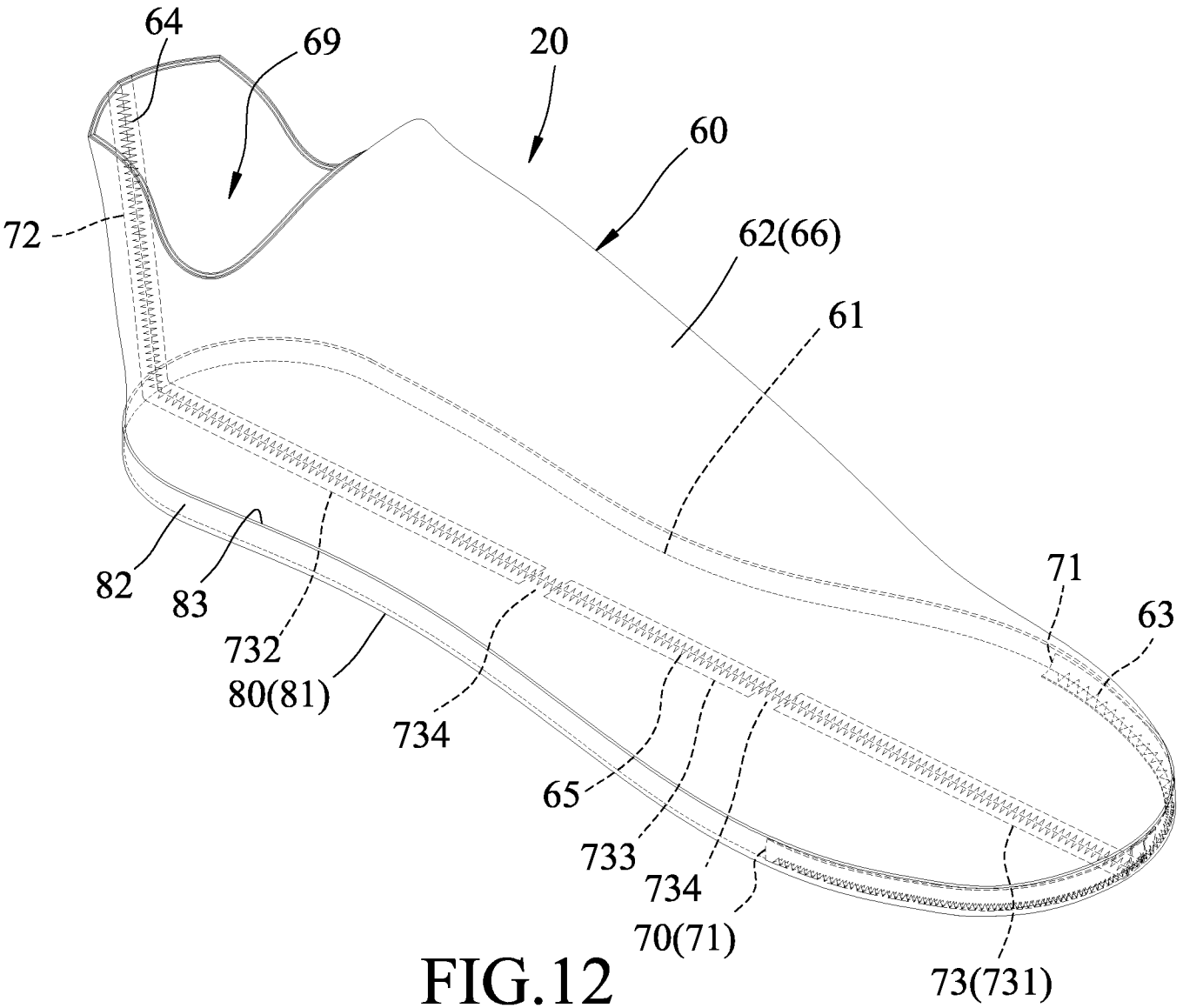
FIG. 12 is an assembled perspective view of the inner sleeve unit.
Figure 13:
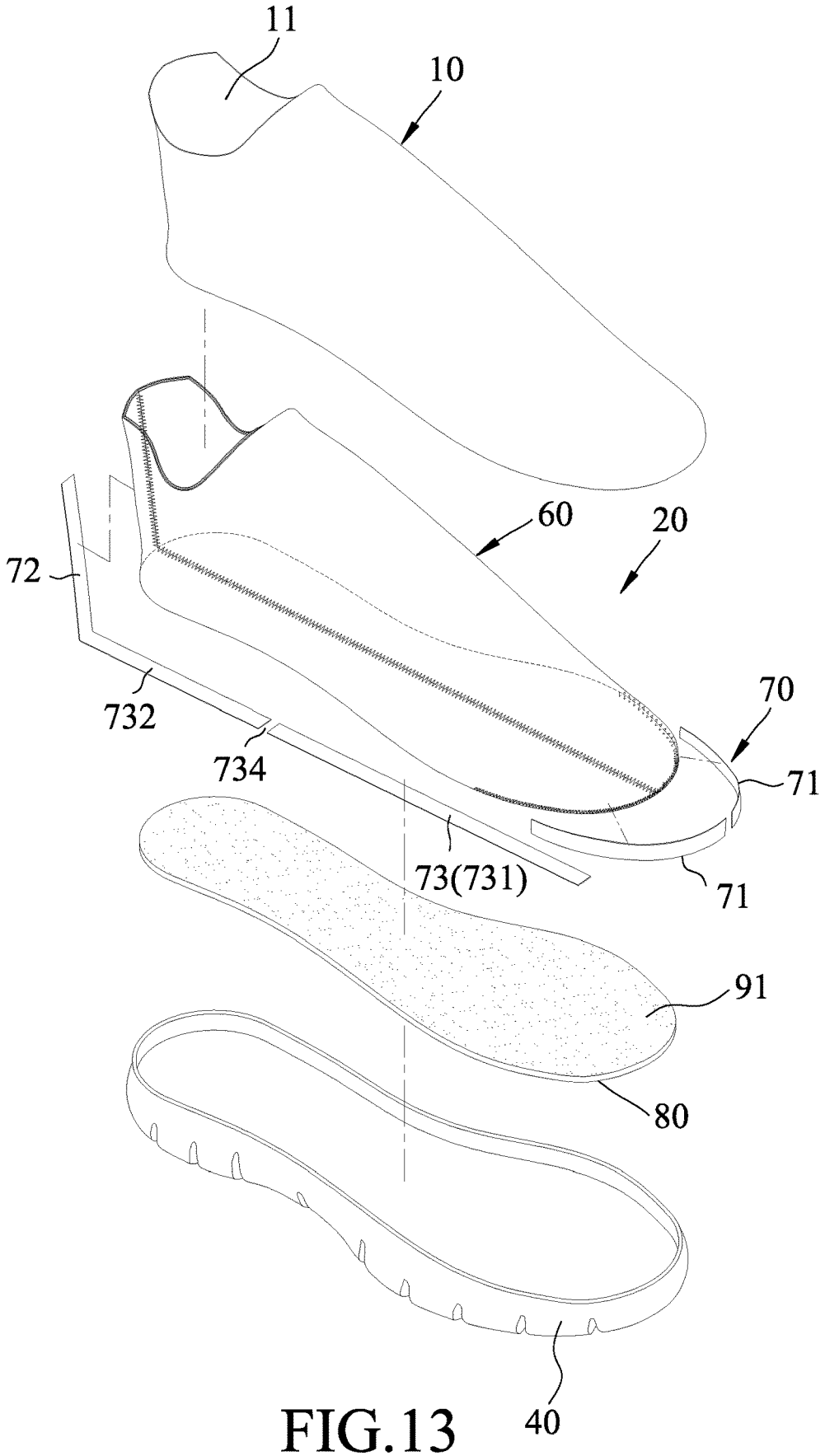
FIG. 13 is an exploded perspective view of a moisture-permeable waterproof shoe according to the second embodiment of the present disclosure.
Figure 14:
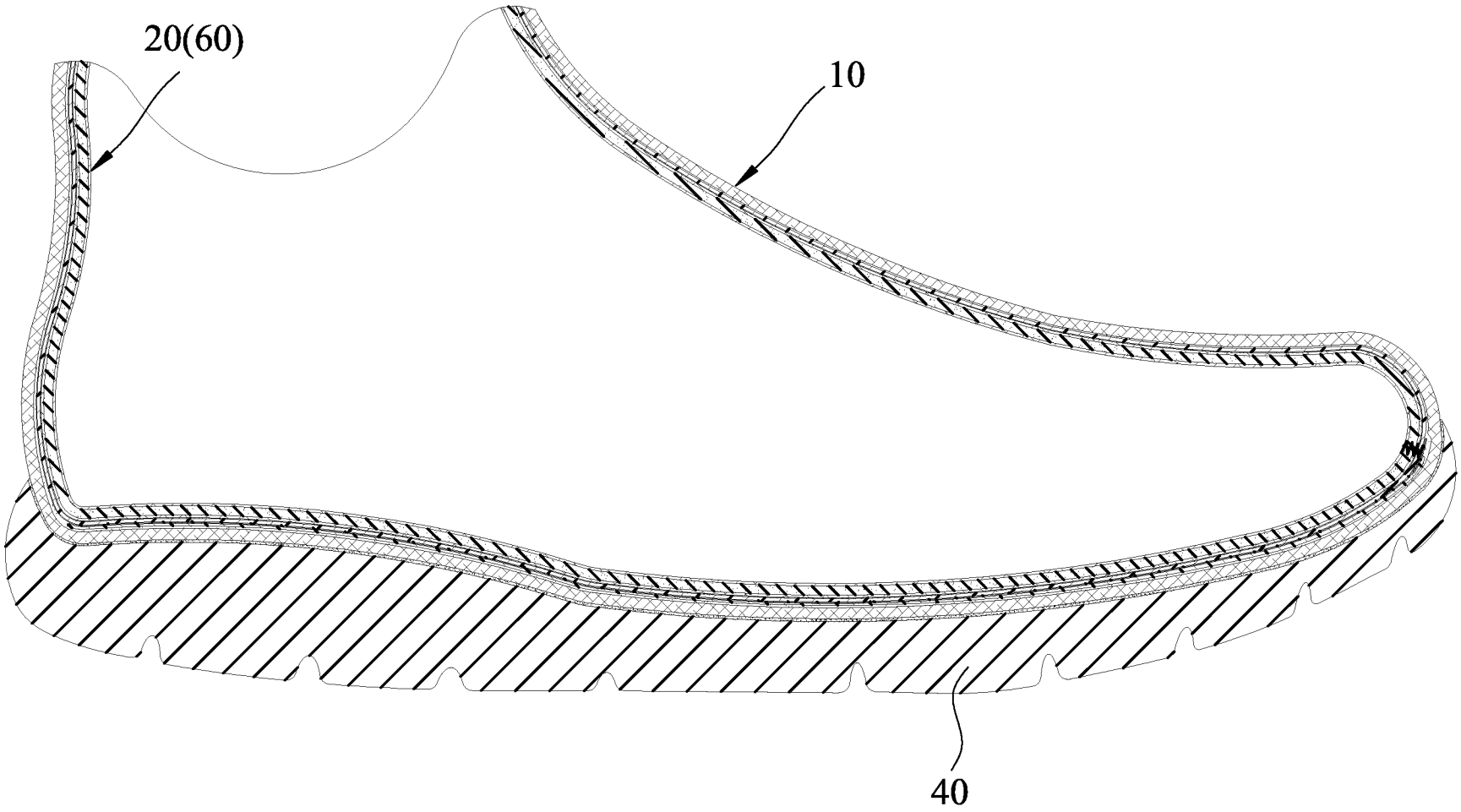
FIG. 14 is an assembled sectional side view of the second embodiment.

Referring to FIG. 12, in combination with FIGS. 5 and 6, the bottom sealing member 80 has a bottom wall 81, and a surrounding wall 82 extending upwardly from a periphery of the bottom wall 81 and cooperating with the same to define a receiving space 83. A bottom portion of the inner sleeve 60 is disposed in the receiving space 83 with the inner sleeve bottom surface 61 fixed to the bottom wall 81 and with the inner sleeve peripheral surface 62 fixed to the surrounding wall 82. In this embodiment, the bottom sealing member 80 completely covers the front end waterproof strips 71 and the bottom waterproof strip 73, and covers a portion of the rear end waterproof strip 72 that is proximate to the rear strip section 732 of the bottom waterproof strip 73.

The bonding layer 90 is bonded between the inner sleeve 60 and the bottom sealing member 80. In this embodiment, the bonding layer 90 is an adhesive layer, but is not limited thereto.

As shown in FIG. 7, in combination with FIGS. 5 and 6, the connecting layer 30 is connected between an inner surface of the upper 10 and an outer surface of the inner sleeve unit 20. In this embodiment, the connecting layer 30 is an adhesive layer, but is not limited thereto.

In this embodiment, the sole 40 is fixed to the bottom portion of the upper 10 and the bottom sealing member 80. The adhesive layer 50 is adhered between the bottom portion of the upper 10 and a top portion of the sole 40 and between the bottom sealing member 80 and the top portion of the sole 40.

The moisture-permeable waterproof shoe 100 of this disclosure utilizes the bottom sealing member 80 to cover the front end waterproof strips 71, the bottom waterproof strips 73, and the portion of the rear end waterproof strips 72 that is proximate to the rear strip section 732 so as to further increase the waterproof effect thereof.

Through the above description, it is apparent that this disclosure utilizes the design of the bottom waterproof strip 73 which is formed with the gaps 734 to allow residual air between the bottom sealing member 80 and the inner sleeve bottom surface 61 to escape into the foot space 69 of the inner sleeve 60 via the gaps 734 and then discharge into the atmosphere during assembly of the bottom sealing member 80 and the inner sleeve 60. Compared to the prior art, no air bubbles will be formed between the bottom sealing member 80 and the inner sleeve bottom surface 61 of this disclosure, so that the bottom sealing member 80 and the inner sleeve bottom surface 61 can be firmly attached to each other, and will not rub against each other which can cause damage to both of them.

Figure 15:
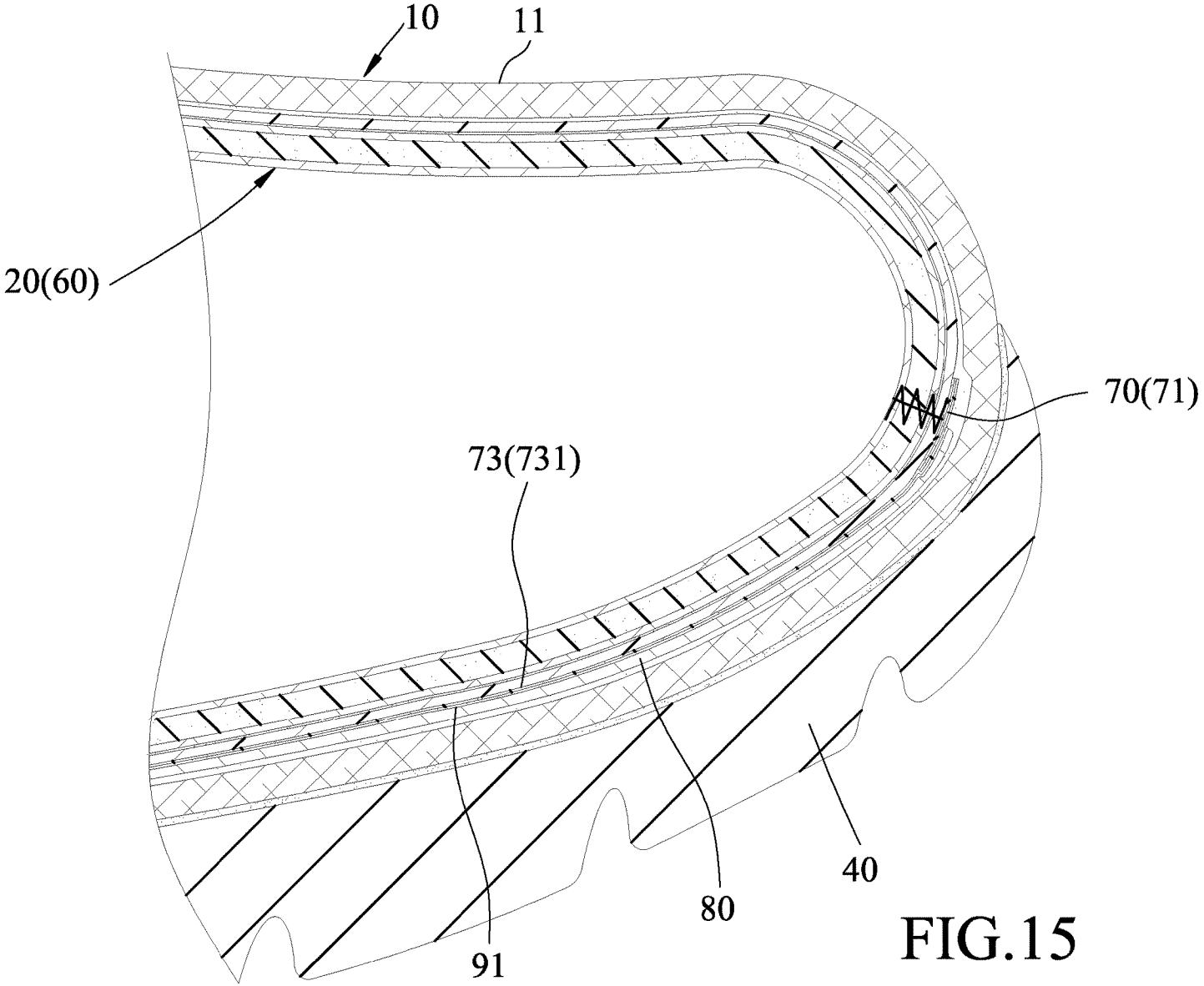
FIG. 15 is an enlarged fragmentary sectional view of FIG. 14.
Figure 16:
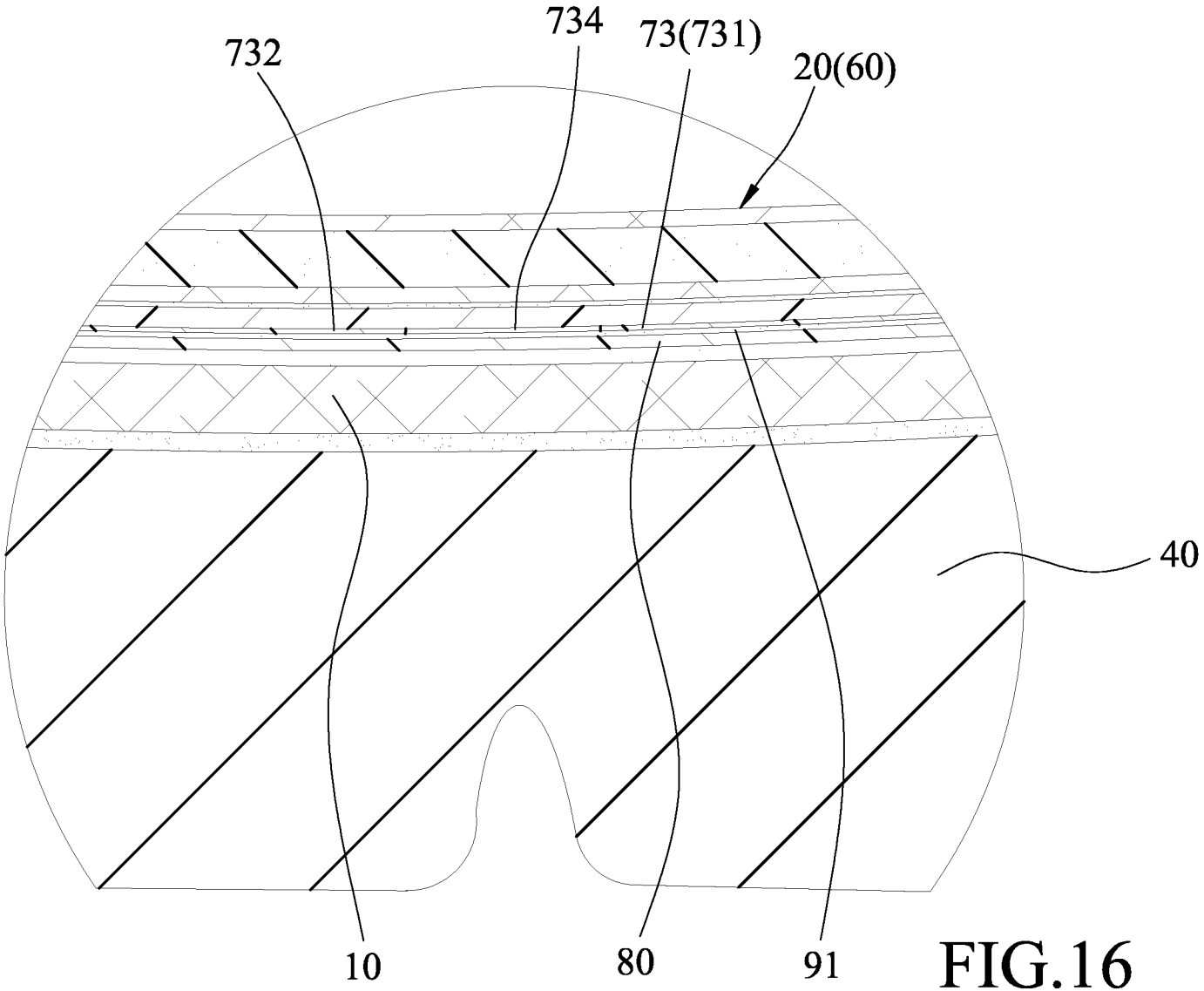
FIG. 16 is another enlarged fragmentary sectional view of FIG. 14.
Figure 17:
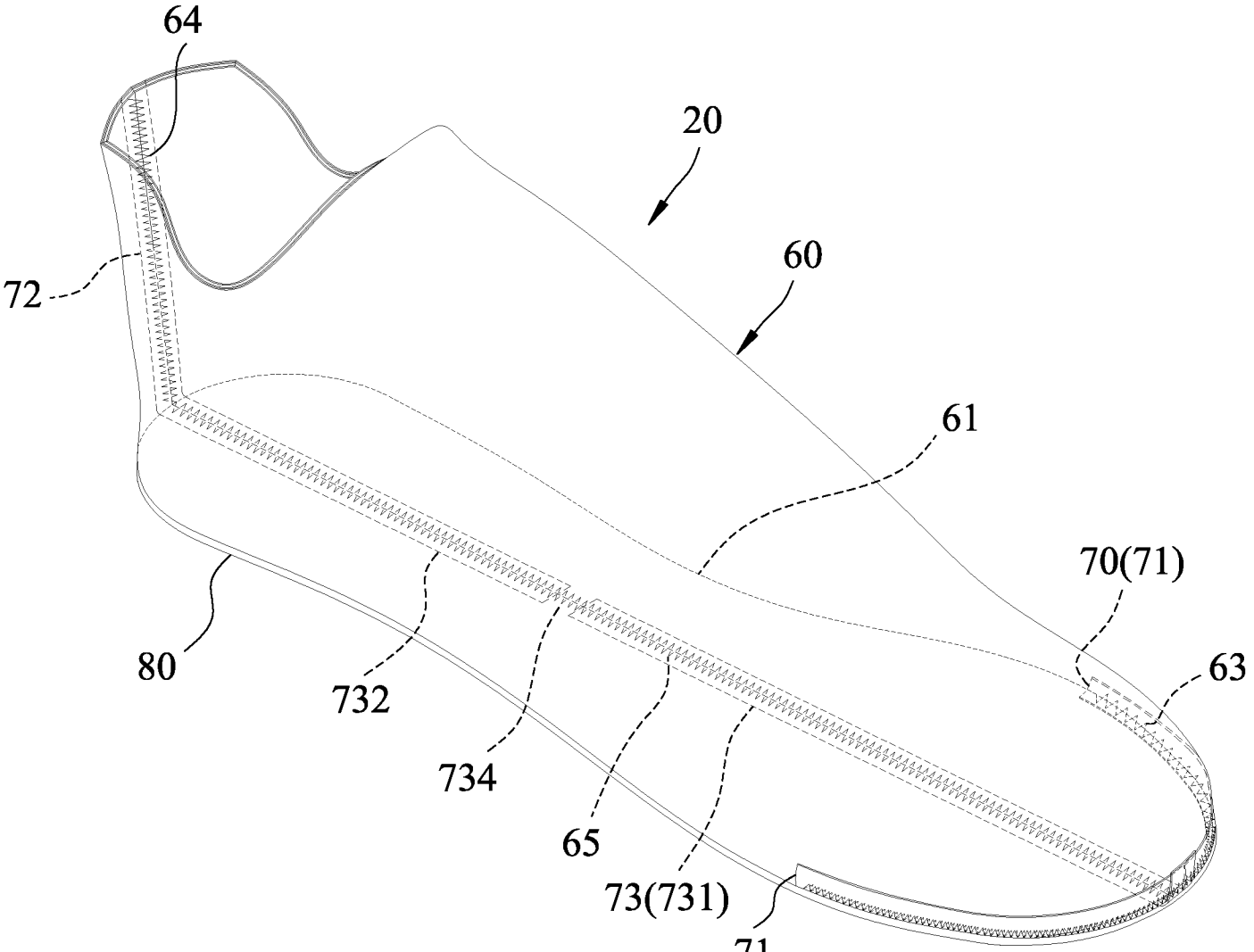
FIG. 17 is an assembled perspective view of an inner sleeve unit of the second embodiment.

Referring to FIGS. 13 to 17, the second embodiment of the present disclosure is similar to the first embodiment, and differs in that, in the second embodiment, the upper 10 has a closed bottom, and is configured as a knitted sock. Moreover, the inner sleeve unit 20 further includes a hot melt adhesive layer 91, and the bottom waterproof strip 73 of the waterproof unit 70 only has the front strip section 731 and the rear strip section 732, and is formed with one gap 734 located between the front and rear strip sections 731, 732. As shown in FIGS. 15 to 17, the bottom sealing member 80 of the inner sleeve unit 20 is a thermoplastic polyurethane (TPU) sheet. The hot melt adhesive layer 91 is coated on a top surface of the bottom sealing member 80, and is adhered between the inner sleeve bottom surface 61 and the top surface of the bottom sealing member 80 by a high frequency welding method. The bottom sealing member 80 covers the front and rear strip sections 731, 732 of the bottom waterproof strip 73.

Thus, the second embodiment can similarly achieve the advantages and effect as described in the first embodiment.

In summary, the moisture-permeable waterproof shoe 100 of this disclosure not only can prevent the residual air between the bottom sealing member 80 and the inner sleeve bottom surface 61 from forming air bubbles, but also damage to the bottom sealing member 80 and the inner sleeve bottom surface 61 can be prevented. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A moisture-permeable waterproof shoe comprising:

an upper defining an interior space and having a top open end communicating with said interior space;

an inner sleeve unit disposed in said interior space and including a shoe-shaped inner sleeve, a waterproof unit, and a bottom sealing member, said shoe-shaped inner sleeve defining a foot space and including an inner sleeve bottom surface, a moisture-permeable waterproof layer located on an outer side of said shoe-shaped inner sleeve, and a bottom seam formed on said inner sleeve bottom surface and extending along a front-rear direction, said shoe-shaped inner sleeve having a top open end communicating with said foot space for entry of a foot of a user thereinto and corresponding to said top open end of said upper, said waterproof unit including a bottom waterproof strip fixed to an outer surface of said moisture-permeable waterproof layer at a position corresponding to said bottom seam so as to cover said bottom seam, said bottom waterproof strip being formed with a gap, said bottom sealing member being fixed to said inner sleeve bottom surface and completely covering said inner sleeve bottom surface, said gap being configured to allow residual air between said bottom sealing member and said inner sleeve bottom surface to escape into the foot space and then discharge into the atmosphere during assembly of said bottom sealing member and said inner sleeve, said bottom waterproof strip including a front strip section and a rear strip section, said gap being located between said front strip section and said rear strip section, and said gap extending from an end of said front strip section to an end of said rear strip section and extending over said bottom seam; and a sole fixed to a bottom portion of said upper;

wherein said shoe-shaped inner sleeve is made from a cut piece, said cut piece having a main body, and two wing portions symmetrically disposed on two opposite sides of said main body and integrally connected as one piece with said main body, said main body having a front convex edge and a rear concave edge opposite to each other, each of said wing portions having a wing lateral edge spaced apart from said main body and having a front end and a rear end, a front curved mating edge connected between said front end of said wing lateral edge and a corresponding one of two opposite ends of said front convex edge, and a rear mating edge connected between said rear end of said wing lateral edge and a corresponding one of two opposite ends of said rear concave edge;

wherein said front curved mating edges of said wing portions are sewn to a periphery of said front convex edge to form a front end seam, said wing lateral edges of said wing portions are sewn to each other to form said bottom seam, and said rear mating edges of said wing portions are sewn to each other to form a rear end seam, thereby forming said shoe-shaped inner sleeve, wherein said front end seam extends along a junction of said periphery of said front convex edge and said front curved mating edges of said wing portions, said bottom seam extends along a junction of said wing lateral edges of said wing portions, and said rear end seam extends along a junction of said rear mating edges of said wing portions and extends upwardly from and is connected to a rear end of said bottom seam, wherein said waterproof unit further includes two front end waterproof strips and a rear end waterproof strip, said front end waterproof strips being fixed to said outer surface of said moisture-permeable waterproof layer at a position corresponding to said junction of said periphery of said front convex edge and said front curved mating edge of each of said wing portions so as to cover said front end seam, said rear end waterproof strip being fixed to said outer surface of said moisture-permeable waterproof layer at a position corresponding to said junction of said rear mating edges of said wing portions so as to cover said rear end seam.

2. The moisture-permeable waterproof shoe as claimed in claim 1, wherein said cut piece includes a lining layer, an outer fabric layer, a foam layer fixed between said lining layer and said outer fabric layer, and said moisture-permeable waterproof layer fixed to an outer surface of said outer fabric layer.

3. The moisture-permeable waterproof shoe as claimed in claim 1, wherein said bottom sealing member is a thermoplastic polyurethane (TPU) sheet, said inner sleeve unit further including a hot melt adhesive layer coated on a top surface of said bottom sealing member, said hot melt adhesive layer being adhered between said inner sleeve bottom surface and said top surface of said bottom sealing member by a high frequency welding method, said bottom sealing member covering said front strip section and said rear strip section of said bottom waterproof strip.

4. The moisture-permeable waterproof shoe as claimed in claim 1, further comprising a connecting layer connected between an inner surface of said upper and an outer surface of said inner sleeve unit.

5. The moisture-permeable waterproof shoe as claimed in claim 1, further comprising an adhesive layer adhered between said bottom portion of said upper and a top portion of said sole.

6. The moisture-permeable waterproof shoe as claimed in claim 1, wherein said gap of said bottom waterproof strip has a length of 1 to 3 cm along the front-rear direction.

* * * * *